United States Patent [19]

Triulzi

[11] 4,300,487

[45] Nov. 17, 1981

[54] ROTARY ENGINE

[75] Inventor: Joseph P. Triulzi, Los Angeles, Calif.

[73] Assignee: Triulzi Rotary, Inc., Chino, Calif.

[21] Appl. No.: 175,025

[22] Filed: Aug. 4, 1980

[51] Int. Cl.[3] ..... F02B 57/06

[52] U.S. Cl. ..... 123/44 C; 123/44 D; 123/44 E

[58] Field of Search ..... 91/491; 123/43 C, 44 C, 123/44 D, 44 E, 55 AA, 55 AB, 65 VC

[56] References Cited

U.S. PATENT DOCUMENTS

| | | | |
|---|---|---|---|
| 1,040,716 | 10/1912 | Manrodt | 123/43 C |
| 1,184,651 | 5/1916 | Johnston | 123/44 D |
| 1,612,046 | 12/1926 | Owens | 123/44 E |
| 2,945,451 | 7/1960 | Griswold | 91/491 |
| 4,078,529 | 3/1978 | Warwick | 123/44 D |

FOREIGN PATENT DOCUMENTS

| | | | |
|---|---|---|---|
| 829848 | 1/1952 | Fed. Rep. of Germany | 91/491 |
| 2807509 | 8/1979 | Fed. Rep. of Germany | 91/491 |
| 431329 | 9/1911 | France | 123/44 C |
| 24327 | 3/1914 | Norway | 91/491 |
| 379561 | 9/1932 | United Kingdom | 123/65 VC |

*Primary Examiner*—Michael Koczo, Jr.
*Attorney, Agent, or Firm*—Singer & Singer

[57] ABSTRACT

A lightweight rotary engine of novel design having a sealed inner portion that allows the engine to assume any attitude during operation. The bottommost portion of each piston contains a bearing roller that is urged against a fixed eccentric post which causes rotation of the rotor assembly. There is no direct connection between the bottommost portion of the pistons and the eccentric post.

The rotor consists of a pair of opposed plates for moving the cylinders in a radial direction. The space between the cylinders contains air chambers for holding air under pressure that is used to scavenge the cylinders.

3 Claims, 8 Drawing Figures

ROTARY ENGINE

This invention relates to a lightweight rotary engine and more specifically to a rotary engine of novel design where there is no direct connection between the pistons and the eccentric post.

In prior art engines, whether they be rotary or internal combustion engines of the conventional type, there has always been a direct connection between the piston through suitable wrist pins and piston rods to a crankshaft of some kind. In conventional engines, movement of the piston drives the crankshaft through the action of the rotating wrist pins and the articulated movement of the piston rod.

In typical rotary engines the outside casing is fixed and the rotor comprising the pistons and associated mechanism rotates within the housing and usually around an eccentric post of some kind.

In the present invention there is absolutely no connection between the pistons and the eccentric about which the rotor rotates. This novel construction allows the centralmost portion defined as the area around the eccentric and the bottommost portion of the pistons within the casing to be completely sealed.

The bottommost portion of each piston contains a roller bearing that is adapted to contact the fixed eccentric post and roll around the post as the rotor rotates within the fixed housing.

Since the internal portion defined by the bottommost portion of the pistons, the post, and the rollers is completely sealed, there is constant lubrication to each of the rollers and the action of each piston operating independently in a radially reciprocating fashion forces the lubrication fluid within the sealed portion to constantly and permanently lubricate all moving bearings.

The unobvious advantage of having a sealed inner section that is lubricated is that the defined rotary engine has no preferred position and hence can be operated in any position whether it is vertical, horizontal, upside-down or even on end.

The rotary engine described herein comprises a fixed housing defining an interior space having a central axis. A fixed post sometimes called the eccentric post is attached to the inside of the housing and extends into the interior space. The eccentric is determined by the distance that the fixed post is offset from the central axis of the housing.

Located within the housing is a rotor that is completely rotatable 360 degrees. The rotor includes a plurality of independent pistons each having a roller bearing on the bottommost portion. Each roller bearing is in contact with the fixed post and is adapted to bear and roll about the post as the rotor is caused to rotate by the actions of the reciprocating pistons.

In the preferred embodiment there are four separate pistons each adapted to make one power stroke per revolution thereby providing four power strokes for each revolution of the rotor. Each piston is disposed to reciprocate radially in a cylinder that rotates as the rotor rotates.

Located as part of the rotor are separate air chambers, each positioned between two cylinders and which are rotatable as the rotor rotates. Each air chamber has ports on each side communicating with circumferential ports located on each cylinder as the piston in each cylinder moves.

The ports are located approximately midway on the cylinder walls and allow air from the air chamber to pass through the ports to scavenge and clean out exhaust air in the cylinder as the piston moves.

An output shaft located coaxially with the central axis projects through the housing and is attached to the rotor.

In the preferred embodiment a centrifugal blower is mounted directly on the outside of the housing. Movable vanes directly attached to the output shaft provide a means for compressing fresh air and feeding said compressed air into each of the air chambers sequentially.

The compressed air contained in each of the air chambers is used for scavenging and purging of the cylinders after the power stroke as the piston moves radially to expose the scavenging air ports located on the periphery of the cylinder walls.

A fixed exhaust port is located on the periphery of the fixed housing and a bifurcated adjustable manifold located over the exhaust port provides an adjustment for selecting a portion of the exhaust gases to be fed either to the muffler for discharge to the atmosphere and a portion of the exhaust gases to be recycled back to the centrifugal blower for recycling into the air chambers. This procedure provides a control over the amount of pollutants discharged into the atmosphere, thereby providing an adjustment for recycling unburned pollutants that should result in a cleaner operating rotary engine.

Further objects and advantages will be made more apparent by referring now to the accompanying drawings wherein.

Figure 1:
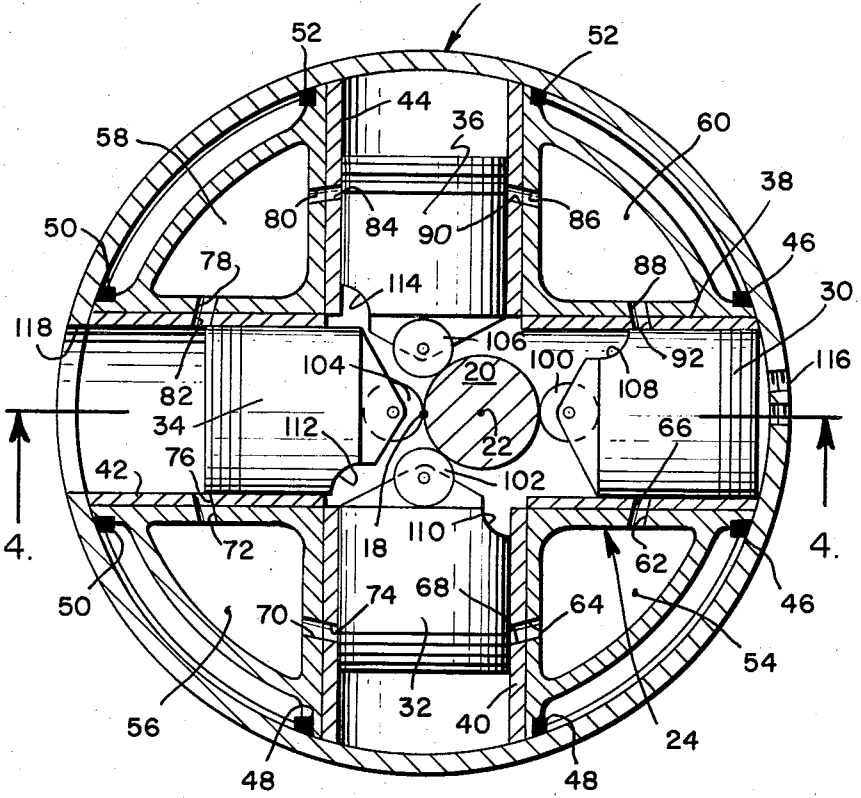
FIG. 1 is a cross-sectional view of the housing and rotor illustrating a four piston rotary engine.

Referring now to FIG. 1, there is shown a rotary engine constructed according to the teachings of the present invention. A fixed housing 10 is preferably constructed of a pair of opposed parallel plates 12 and 14 connected together by means of an arcuate member 16 which defines an interior surface as more fully illustrated in connection with FIG. 4.

The center of the interior chamber is symmetrical about a central axis defined as 18.

In the preferred embodiment a fixed post 20 is fixedly attached to end plate 12. The fixed post 20 has a center line 22 that is displaced from the central axis 18 by a given amount. The distance between the central axis 18 and the center line 22 of the post 20 is defined as the eccentric distance and determines the stroke for each of the pistons comprising the rotary engine.

Located within the chamber defined between the end plates 12 and 14 and the arcuate member 16 is a rotor assembly 24.

The rotor assembly 24 consists basically of a pair of end plates 26 and 28 adapted to rotate within the defined chamber. The end plates 26 and 28 contain a plurality of pistons orthogonally related to each other and air chambers located between each set of pistons.

In the preferred embodiment the rotor comprises four pistons 30, 32, 34 and 36. Each of the pistons 30, 32, 34 and 36 are located in a cylinder having a circular liner 38, 40, 42 and 44, respectively, a cylinder for accepting the pistons.

Each of the four pistons is located orthogonally with respect to each other and each contain a pair of centrifugal bearings 46, 48, 50 and 52, respectively, for sealing the cylinder walls to the outer housing 10.

The bearings may either be centrifugal or spring-loaded in a manner consistent with the teaching of the art.

Located between each pair of pistons is an air chamber 54, 56, 58 and 60, each located between adjacent pistons and formed between opposing end plates 26 and 28.

Each of the air chambers communicates with scavenging ports located on the circumference of adjacent cylinders.

For example, chamber 54 located between piston 30 and 32 has ports 62 and 64 communicating with scavenging ports 66 and 68 located on liners 38 and 40, respectively. In a similar fashion air chamber 56 has ports 70 and 72 communicating with scavenging ports 74 and 76 located on liners 40 and 42, respectively. Air chamber 58 has ports 78 and 80 communicating with scavenging port 82 and 84 located on liners 42 and 44, respectively. Lastly, air chamber 60 has ports 86 and 88 communicating with scavenging ports 90 and 92 located on liners 44 and 38, respectively.

By way of review, it will be appreciated that each cylinder has scavenging ports communicating with a pair of adjacent air cylinders for scavenging the cylinder during the proper timed operation of the piston movements.

In the normal configuration each of the pistons are adapted to cover the ports in a liner until the piston approaches bottom dead center at which time the ports are exposed allowing air located within the air cylinder to be released through the scavenging ports and for their intended purposes. The exact operation will be described in connection with FIGS. 1, 2 and 3.

The engine being described is a two stroke, four cylinder rotary engine and in which each piston makes one power stroke for each revolution, thereby providing a total of four power strokes for one revolution of the rotor assembly 24.

The bottommost portion of each piston contains a roller bearing adapted to contact and roll along the circumference of the fixed post 20. For example, located on the bottommost portion of piston 30 is a roller bearing 100 in direct contact with the periphery of fixed post 20. Similarly, roller bearing 102 is located on the bottommost portion of piston 32 and in contact with the periphery of fixed post 20. In a similar fashion roller bearing 104 is fixedly attached to the bottommost portion of piston 34 and in contact with the periphery of fixed post 20 and lastly, roller bearing 106 attached to the bottommost portion of piston 36 is in contact with the circumference of fixed post 20.

In the preferred embodiment, roller bearings 102 and 106 on pistons 32 and 36, respectively, are bifurcated in order to supply the necessary clearance.

A careful review of FIG. 1 will show that each of the bearings 100, 102, 104 and 106 are not fixedly attached to the post 20 but rather are simply adapted to bear upon the periphery of the post and to rotate about the periphery of the post as the rotor assembly 24 rotates.

A review of the geometry will show that the diameter of the fixed post 20 determines the stroke of the individual pistons 30, 32, 34 and 36 and, hence, the power ouput of the rotary engine is carefully determined by the internal diameter of the outer housing 10, the diameter of the individual pistons, and the stroke of the pistons as determined by the thickness of the fixed post 20.

Theoretically any number of pistons may be used in the construction of the rotary engine, however, practical considerations appear to limit the number of pistons in a given plane to four in view of the clearance and tolerances required between the bottommost portion of adjacent pistons.

In order to provide the necessary clearance between opposing pistons, a cutout located on one side of each of the pistons and on the same side has been found necessary for a four piston rotary engine. This cutout takes the form of an arcuate shape 108 on piston 30, an arcuate shape 110 on piston 32, an arcuate shape 112 on piston 34, and an arcuate shape 114 on piston 36.

Located on the outer wall of the housing 10 opposite piston 30 is a suitable glow plug 116 that would be necessary for burning diesel fuel. The actual device used to ignite the fuel is a function of the fuel being used.

Since a two stroke single cycle engine is being described, a suitable exhaust port 118 is located on the periphery of the housing 10 and in a location opposite the glow plug 116.

Figure 2:
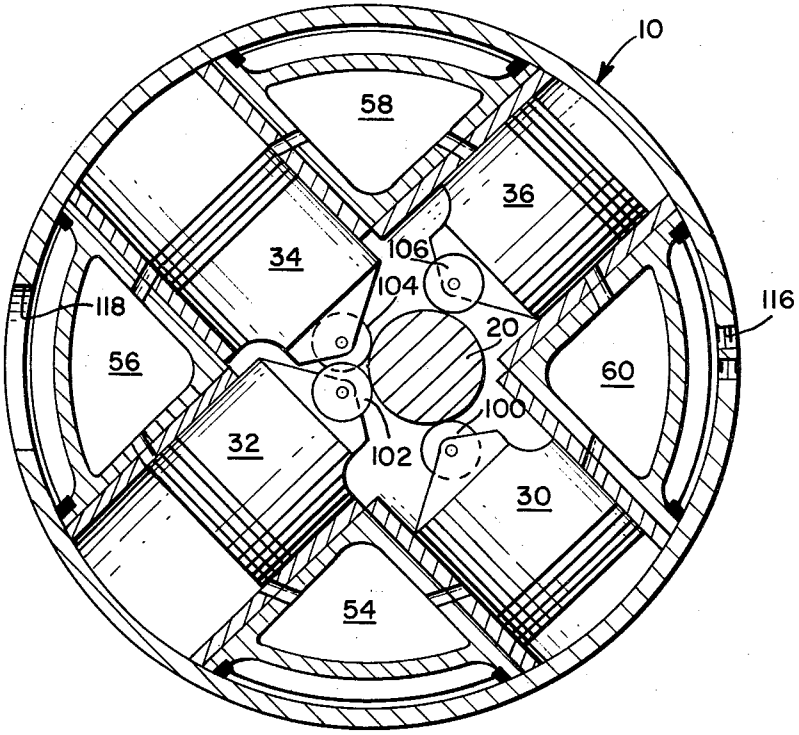
FIG. 2 is similar to FIG. 1 but shows the rotor having rotated 45 degrees in a clockwise direction.
Figure 3:
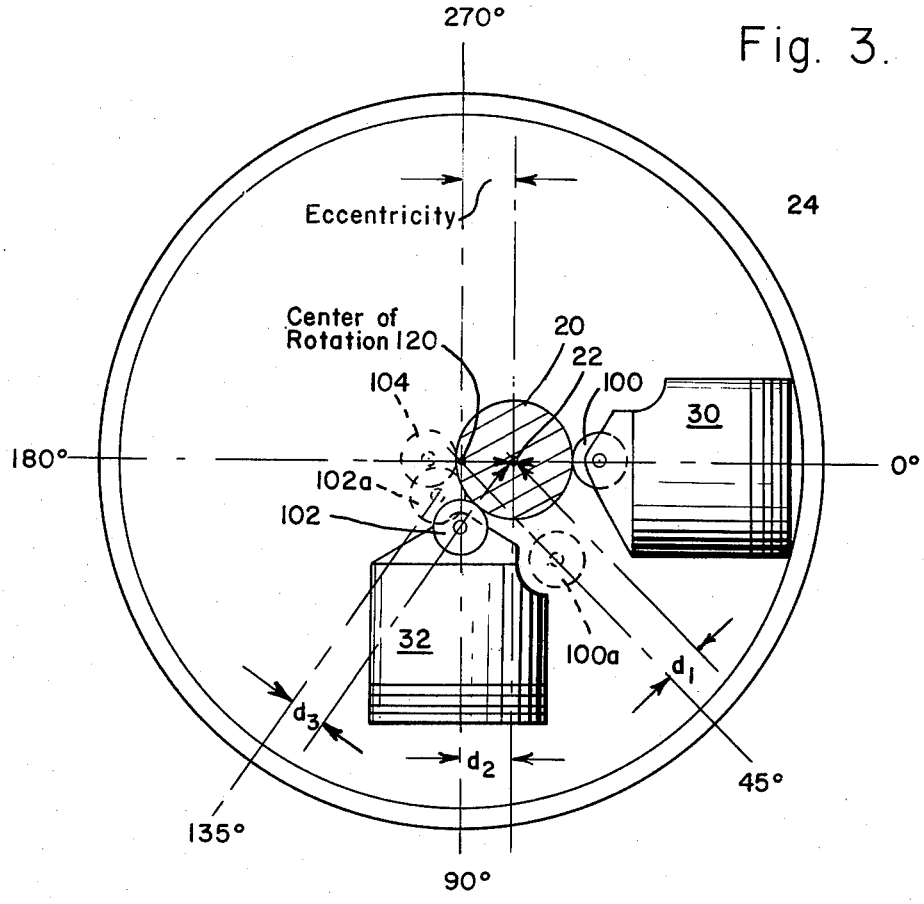
FIG. 3 is a schematic diagram illustrating how pistons acting upon the stationary post cause rotation of the rotor.

In order to obtain a better understanding of how a force exerted on the individual pistons in pushing against the fixed post 20 cause the rotor assembly 24 to rotate, reference is now made to FIGS. 1, 2 and 3.

The rotary engine is started as with all other internal combustion engines by having an external means such as a starting motor or pneumatic means or mechanical means rotate the rotor assembly 24. For purposes of illustration we will assume FIG. 1 illustrates the rotor in the position indicated which is with piston 30 fully compressing a charge of air and fuel to its maximum compression position in a position for glow plug 116 to cause ignition and expansion of the compressed gases. Piston 32 as indicated in FIG. 1 has already received a firing stroke and is being forced radially inward with bearing 102 contacting the periphery of post 20. Piston 32 is still covering scavenging ports 68 and 74 since the gases are still expanding.

Piston 34 is shown in a dead center position with all its expansive gases fully expended and with the top of the piston 34 exposing scavenging ports 76 and 82 which has the effect of allowing gas under pressure located in chambers 56 and 58 to pass through the scavenging ports and out the exhaust opening 118.

Piston 36 is now moving radially away from the center of the fixed post 20 and the cylinder has already received the charge of air which is now being compressed by the movement of piston 36.

Referring now to FIG. 2, the rotor assembly 24 is shown rotated approximately 45 degrees with piston 30 moving radially inward towards the post as the compressed gases expand. The force exerted by the roller bearing 100 on the periphery of the post imparts a coupling action around post 20 to rotate the rotor assembly 24. This coupling force will be described in more detail in connection with FIG. 3.

In a similar fashion a review of piston 32 will show a continuing movement of the piston radially inward towards the post 20 under the actions of the expanded gas. The force on piston 32 maintains roller bearing 102 in direct contact with the periphery of the fixed post 20 thereby continuing to develop a coupling force for rotating the rotor assembly 24.

Piston 34 has passed through the dead center bottommost portion and is now moving radially outward as roller bearing 104 contacts the periphery of the fixed post 20. In this position the movement of the piston 34 has covered the scavenging ports and the gas mixture is being compressed as the piston moves radially outward.

Piston 36 continues to move radially outward under the action of fixed post 20 bearing against roller bearing 106. The cycle is complete when piston 30 as illustrated in FIG. 1 again reaches the same position to complete the one full cycle and the one power stroke.

Referring now to FIG. 3, there is shown a more schematic diagram illustrating how the movement of the pistons on the rotor assembly 24 cause rotation as a result of the offsetting of the fixed post 20 from the central axis 18.

As previously described, the fixed post 20 has an axis that is offset from the central axis 18. This offset is called the eccentricity dimension. The rotor assembly 24 rotates about the center of rotation 120 which is located on the central axis 18. The coupling force driving or attempting to rotate the rotor assembly 24 is the parallel distance between the force from the individual roller bearing passing through the center of the fixed post 20 and a parallel line passing through the center of rotation.

For example, a review of piston 30 will show that the force passing through the roller bearing 100 will pass through the center of the fixed post 20 and also pass through the center of rotation 120. Since there is no parallel dimension between this generated force, there will be no coupling force imparted to the rotor assembly 24. This of course is consistent with a review of the geometry of FIG. 3 since intuitively it can be reasoned that without an offset angle between the force and the center of rotation there can be no torque generated attempting to rotate the rotor assembly.

A review of the piston 30 in an advanced position identified by roller 100*a* will show that a force through roller bearing 100*a* will pass through the center of the fixed post 20 and that the eccentric pistons between this force and a parallel line passing through the center of rotation 120 and identified as d-1 is the coupling force times the distance that will cause or impart a rotational movement to the rotor assembly 24. In a similar fashion a review of piston 32 and roller bearing 102 will show that the force through bearing 102 and passing through the center of the fixed post 20 will generate a coupling force determined by the distance between a parallel line passing through the center of rotation 120 and the force passing through the center of the fixed post 20 and which is identified as distance d-2, which coupling force attempts to continue the rotation of the rotor assembly 24.

In a similar fashion the continuing rotation of piston 32 to an advanced position as identified by roller 102*a* will show a force through the roller 102*a* through the center of the fixed post 20 developing a coupling force as measured by a distance between a parallel line passing through the center of rotation 120, which distance is measured by distance d-3. The total coupling force generated is a function of the actual force times the distance, which coupling force attempts to continue the rotation of the rotor assembly 24.

Roller bearing 104 will not generate a coupling force since the contacting force passes through the center of rotation 120 and the center of the fixed post 20. In this position as in the original position of piston 30, there is no eccentric distance for the force to act through and hence there is no coupling force generated. It will be apparent therefore that the bearing rollers indicated as roller 100 and roller 104 are actually at top dead center and top bottom center, respectively, and in either position do not generate a coupling rotational force.

Figure 4:
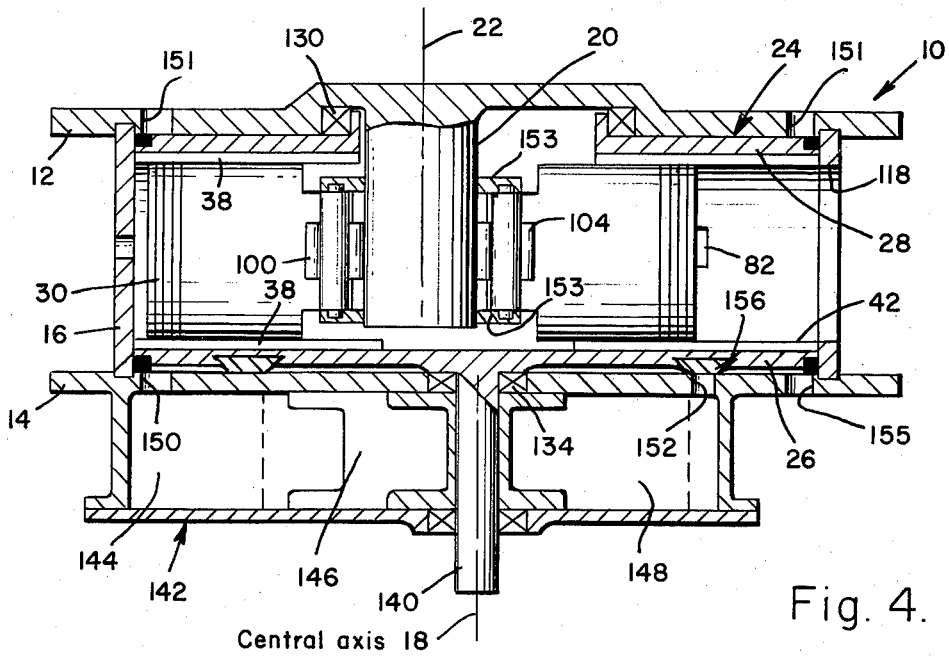
FIG. 4 is a cross-section taken along lines 4—4 of FIG. 1.

Refering now to FIG. 4, there is shown a cross-section taken along lines 4—4 of FIG. 1. In this view the eccentricity as defined by the distance between the central axis 18 and the center of post 20 is more easily seen.

FIG. 4 also shows more graphically how bearings 130 on end plate 12 and bearings 134 on end plate 14 support the complete rotor assembly 24.

An output shaft 140 is directly connected to the rotor assembly 24 and passes through the end plate 14. The output shaft 140 is located coaxial with the central axis of the rotor assembly.

In the preferred embodiment a centrifugal blower assembly housing 142 is located on the end plate 14 so as to form an interior chamber 144.

A plurality of extendable vanes 146 are directly connected to the output shaft 140 and rotate as the shaft rotates. The extendable vanes 146 are adapted to completely fill the interior chamber 144 and as the shaft 140 rotates the extendable vanes 146 are compressed to a smaller length as at 148 where the chamber is narrowed and the trapped air is compressed to a higher pressure. A port 150 located on the end plate 14 provides a continuous supply of air to be compressed by the action of the rotating vanes 146. The compressed air at the maximum pressure portion of the centrifugal blower is located where vanes 148 are the smallest in length. Located at the highest pressure portion is a controllable port 152 that is adapted to communicate with each of the individual air chambers 54, 56, 58 and 60, respectively, as illustrated in FIG. 1.

The port 152 is controlled by a ring valve assembly 156 and which is more fully illustrated in connection with FIG. 5. The ring valve 156 is actually a ring having four ports 158, 160, 162 and 164, each positioned over an air chamber 54, 56, 58 and 60, respectively.

Figure 6:
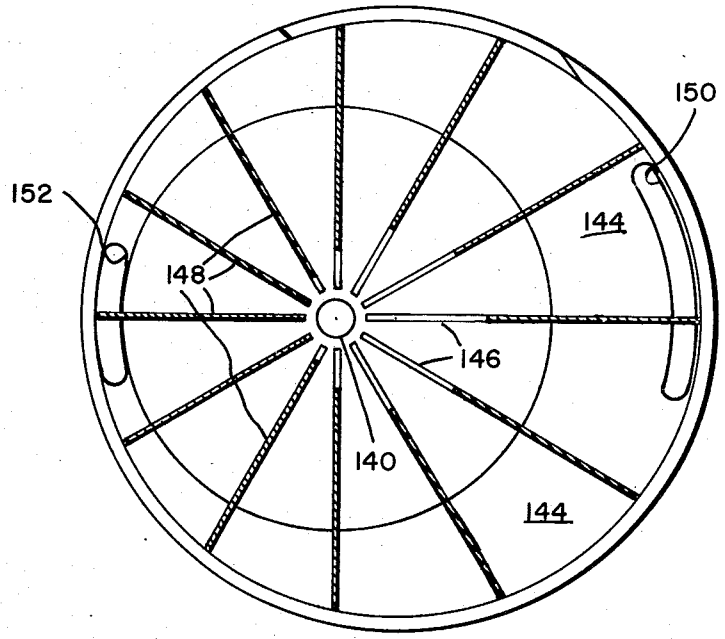
FIG. 6 is a plan view of the stator illustrating the centrifugal blower.
Figure 5:
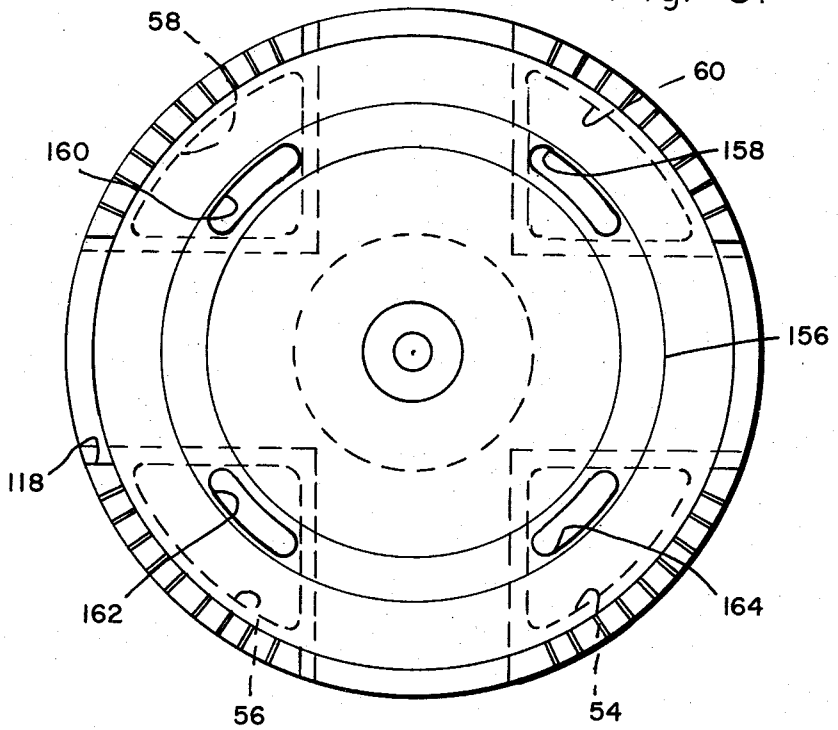
FIG. 5 is a plan view of the rotor illustrating the individual ports associated with each air chamber.

By referring now to FIGS. 4, 5 and 6, there is shown the intake port 150 which is always open to provide intake air to the centrifugal chamber 144. Port 152 is always open and is located diametrically opposite the intake port 150 as is more fully illustrated in FIG. 6. Intake port 150 and exhaust port 152 are located on the fixed housing and do not rotate. The ring assembly 156 which is illustrated in FIGS. 4 and 5 is a ring having four ports that are fixedly attached to the end plate 26 of the rotor assembly 24 and hence the ring assembly 156 rotates as the rotor assembly 24 rotates.

A plurality of intake ports 151 (see FIG. 7) located on end frame 12 and ports 155 located on end frame 14 provide a source of cooling air for the rotor and fresh air for the compressor.

A pair of retaining rings 153 lightly pre-load all four piston bearings 100, 102, 104 and 106 against the fixed post 20. The geometry is such that the axis of all four bearings define a circle. The retaining rings 153 maintain contact between the bearings and the post 20 during the non-combustion stroke of each piston.

Referring now to FIG. 5, it will be appreciated for example that as the rotor assembly 24 rotates and port 162 located over chamber 56 passes under exhaust port 152 and that the centrifugal blower 142 will charge chamber 56 with a charge of air from the high pressure end where vanes 148 are located and in turn each of the chambers 54, 60 and 58 will be charged once during each revolution as the rotor assembly 24 rotates.

Figure 7:
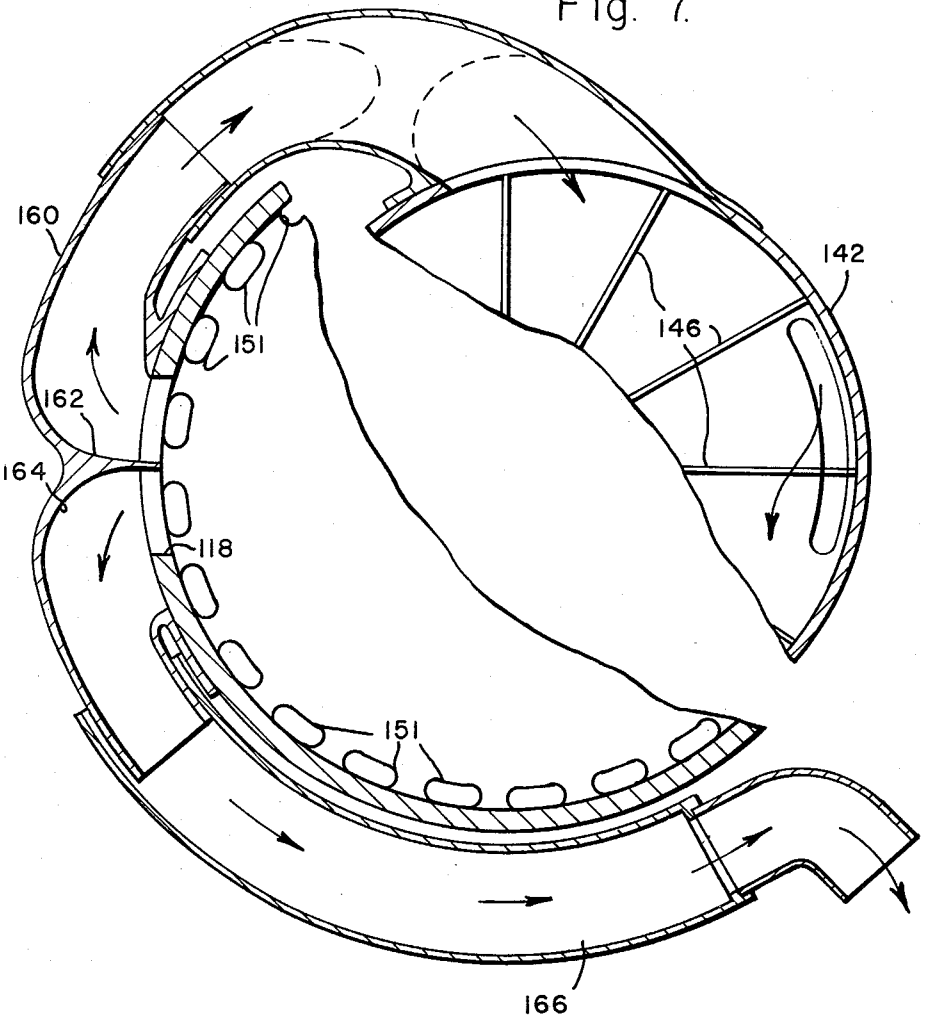
FIG. 7 illustrates the adjustable manifold for selecting a portion of the exhaust gases to be recirculated to the air chamber.

Referring now to FIG. 7, there is shown a bifurcated adjustable manifold 160 positioned over the exhaust valve 118 located on the fixed housing and having a first chamber 162 for deflecting a portion of the exhaust gases in a first direction for recycling and a second chamber 164 for deflecting a portion of the exhaust gases to a suitable muffler 166 for exhausting to the atmosphere.

The manifold 160 is adjustable over the exhaust valve 118 in order to provide a means of selecting a greater or lesser percentage of the gases to be recycled. It is envisioned that the initial products of combustion will be highly burned and that the secondary products of combustion will have more pollutants that should be recaptured by chamber 162 and fed back into the air intake feeding the centrifugal blower chamber 142. In this fashion the recycled gases will be fed into the air intake feeding the chamber 142 comprising the centrifugal blower, causing the air to be compressed and fed back into the individual air chambers as previously described.

Figure 8:
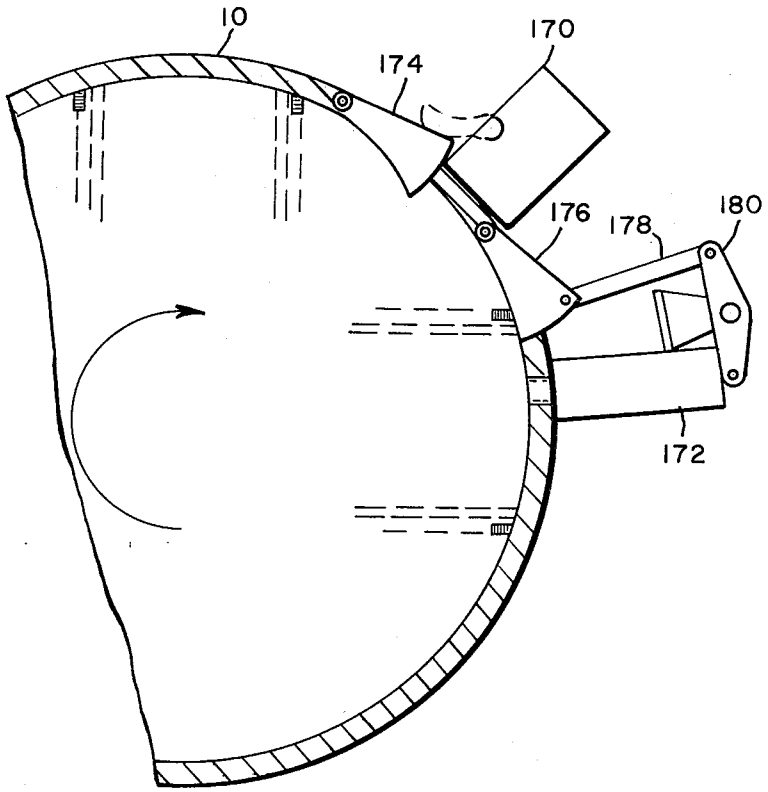
FIG. 8 illustrates a preferred embodiment for driving auxiliary equipment such as timing cams and fuel pumps associated with the proper operation of the engine.

Referring now to FIG. 8, there is shown in schematic form a conventional fuel pump 170 and injector 172 located on the periphery of the housing 10. A rocker arm 174 and pivotably attached to the housing 10 is contacted by each of the rotating cylinders thereby providing four strokes per engine revolution. The fuel pump 170 is a standard fuel pump actuated by the rocker arm 174 which is incorporated into the circular housing wall.

A similar cam arrangement 176 acting through a linkage 178 and a rocker arm 180 actuates the fuel injector 172 as each cylinder passes. The fuel injector 172 is standard and the arm and linkages are conventional.

The injection of the fuel into the fully compressed cylinder is scheduled to start at 350 degrees and to be completed at 355 degrees with ignition to take place at 360 degrees. The actual timing will be a function of the size of the engine, speed and other tests that are normally and conventionally made to engines when determining the actual timing periods.

The engine described is basically a two cycle multi-piston internal combustion rotary engine designed primarily for diesel fuel injection but which may also use other types of fuels.

The chamber created within the rotor bounded by the drive plate, the eccentric post end plate and the roller side of the pistons is charged with lubricating oil. The centrifugal action of the rotating engine forces the oil to the outward cavities and surfaces where it tends to accumulate. However, each piston during the expansion cycle forces the oil captured to be expelled radially inward where it is in a free centrifugal field. Subsequently this oil is thrown into the adjacent chamber created by the contracting piston thereby developing continuous oil circulation.

This inner chamber bounded by the bottommost portion of all four pistons is an area sealed with the lubricating oil and hence the engine may be placed in any location and positioned for operation without affecting lubrication of the essential portions.

Lubrication of the inner surface of the circular housing is by controlled leakage of the main lubricating oil supply. This oil is dripped through a fixed orifice against the inner surface at a constant rate per revolution. This oil is not recoverable.

I claim:

1. A rotary engine comprising:

a fixed housing defining an interior space having a central axis, a fixed post attached to said housing and extending into said space, said post being offset from said central axis, a rotor including a pair of opposed plates rotatable within said housing, said rotor including a plurality of independent pistons each having a bearing on the bottommost portion for bearing and rolling about said post whereby actuating the pistons causes the rotor to rotate, each piston is disposed to reciprocate radially in a cylinder rotatable with said rotor and located between said opposed plates, similar air chambers for holding air under pressure located between said plates and disposed between said cylinders and rotatable as said rotor rotates, a rotary output shaft projecting through said housing and attached to said rotor, said output shaft being coaxial with said central axis, a centrifugal blower having extending vanes directly attached to said output shaft and mounted directly on the outside of said housing, and a rotating valve having a plurality of ports one for each chamber and attached to said rotor for providing a passageway from said blower to each of said chambers sequentially for charging each of said chambers with air under pressure.

2. A rotary engine according to claim 1 which includes an exhaust port on said housing for removing products of combustion from said cylinders in sequence as said rotor rotates, a bifurcated adjustable exhaust manifold located over said exhaust port for directing a first portion of exhaust gases to a muffler and a second portion of exhaust gases to said centrifugal blower for recirculation to said air chambers.

3. A rotary engine according to claim 2 in which said bifurcated adjustable exhaust manifold is rotatably adjustable over said exhaust port to vary the portion of exhaust gases being recycled to said blower.

* * * * *